US005607331A

United States Patent [19]

Lekhtman

[11] Patent Number: 5,607,331

[45] Date of Patent: Mar. 4, 1997

[54] WATER WALKING APPARATUS

[75] Inventor: David Lekhtman, Quebec, Canada

[73] Assignee: Damar Leisure Products Inc., Montreal, Canada

[21] Appl. No.: 382,124

[22] Filed: Feb. 1, 1995

Related U.S. Application Data

[63] Continuation-in-part of Ser. No. 206,890, Mar. 7, 1994, abandoned.

[51] Int. Cl.[6] ..... B63H 16/08

[52] U.S. Cl. ..... 440/23; 441/76

[58] Field of Search ..... 441/76, 77; 440/18, 440/21, 23, 38

[56] References Cited

U.S. PATENT DOCUMENTS

| | | | |
|---|---|---|---|
| 3,408,976 | 11/1968 | Ellis . | |
| 3,479,674 | 11/1969 | Beymer . | |
| 3,487,806 | 1/1970 | Ch'iu . | |
| 3,971,330 | 7/1976 | French . | |
| 4,481,002 | 11/1984 | Gargos . | |
| 4,954,106 | 9/1990 | Shuh-Chin | 440/21 |
| 5,267,883 | 12/1993 | Gudmundsen | 440/38 |

FOREIGN PATENT DOCUMENTS

| | | | |
|---|---|---|---|
| 913868 | 5/1954 | Germany | 440/23 |
| 2321997 | 11/1974 | Germany . | |
| 2840505 | 3/1980 | Germany . | |

*Primary Examiner*—Sherman Basinger
*Attorney, Agent, or Firm*—Fishman, Dionne & Cantor

[57] ABSTRACT

A float member has a top surface, a bottom surface, a front end and a rear end. A pair of elongated chambers extend in the float member between the top surface and the bottom surface. Each elongated chamber has respective openings at the top surface and bottom surface and rear end. Flap valves are provided for permitting water to enter through the bottom openings of the elongated chambers and foot pumps are provided for ejecting water through the rear ends of the chambers.

7 Claims, 3 Drawing Sheets

56
62
58
17
15
19
22
24
20
18
16
13
10

58
62
10
17
19
15
40
13
42
64
66
50
52
36a
38a
11

WATER WALKING APPARATUS

REFERENCE TO RELATED APPLICATION

This application is a continuation-in-part of application Ser. No. 08/206,890, filed Mar. 7, 1994, and now abandoned.

BACKGROUND OF INVENTION

1. Field of the Invention

The invention relates to a jet-propelled water walker apparatus. More specifically, the invention relates to an improvement in such jet-propelled water walker apparatus.

2. Description of Prior Art

Jet-propelled water walker apparatus are known in the art as taught in, for example, U.S. Pat. No. 5,267,883, Gudmundsen, U.S. Pat. No. 4,954,106, Shuh-Chin, U.S. Pat. No. 4,481,002, Gargos, U.S. Pat. No. 3,971,330, French, U.S. Pat. No. 3,487,806, Ch'iu and U.S. Pat. No. 3,408,976, Ellis.

The '883 patent teaches a water-jet propulsion system consisting of chambers 4 having an inlet port 5 and an outlet port 6. Water is drawn into the chamber and driven out of the chamber by reciprocating air pump 3.

The aquatic sports device of the '106 patent consists of a body made of a light-weight material which includes a water tank, a piston, a seal, a retractable spring, a water incoming passageway or pipe, a one-way valve, a water discharge passageway or pipe and a nozzle. Water is drawn into the pipe at the front end and ejected from the nozzle at the back end by action of the piston together with the retractable spring.

U.S. Pat. No. 4,481,002 teaches an arrangement which is powered automatically by waves of a body of water. A float member moves up and down due to the action of the waves and, in turn, drives member up and down about pivot point. This moves pistons inwardly and outwardly into cylinders. Water is drawn inwardly when the pistons are moved to the left in FIG. 2.

The propulsion system of the '330 patent is hand- operated by movement of a lever upwardly and downwardly. As can be seen, the housing of the propulsion system includes a bottom inlet with a flap valve covering the bottom inlet. Water is ejected through exhaust opening.

The jet powered vessel of the Ch'iu patent includes two piston and cylinders. Each piston and cylinder connects with a respective pipe, and the two pipes are connected through a T-joint to exhaust outlet. Each piston and cylinder has a bottom opening which is covered by a flap valve. The propulsion system of this patent is also foot operated.

The propulsion system of the '976 patent uses a centrifugal pump to draw water into a hollow compartment through bottom intake strainer plate. The water is then ejected through a rear outlet to provide a reaction force for moving the surfboard.

U.S. Pat. No. 3,479,674, Beymer, also teaches a jet-propelled water walking system. The water walkers in the '674 patent and the '422 application comprise arrangements wherein water is drawn in through a front end of a chamber and expelled through the rear end thereof.

SUMMARY OF INVENTION

It is an object of the invention to provide a water walker apparatus which comprises an improvement over the prior art.

It is a more specific object of the invention to provide such a water walking apparatus wherein the chambers are filled more quickly so that the user displays a more walking-like motion in operation of the apparatus than in prior art devices.

In accordance with the invention, the chambers are filled through an opening or openings which extend along the length of the bottom surface thereof whereby the water rises quickly into the chamber to fill the chamber.

In accordance with a particular embodiment of the invention there is provided a water walking apparatus for moving a single user across water, comprising:

- a float member having a top surface, a bottom surface, a front end and a rear end;
- a first chamber in the float member between the top surface and the bottom surface, and a second chamber between the top surface and the bottom surface;
- each chamber having a bottom opening at the bottom surface and an exhaust nozzle communicating with the chamber towards the rear end of the float and submerged in the water when the float member is floating on the water;
- valve means for permitting water to enter through said bottom opening of the chamber;
- the valve means and the bottom opening extending along the length of the chamber; and
- a foot operated piston in each of the respective chambers to displace water from the chamber through the exhaust nozzle to create a jet rearwardly of the float for moving the float across the water.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
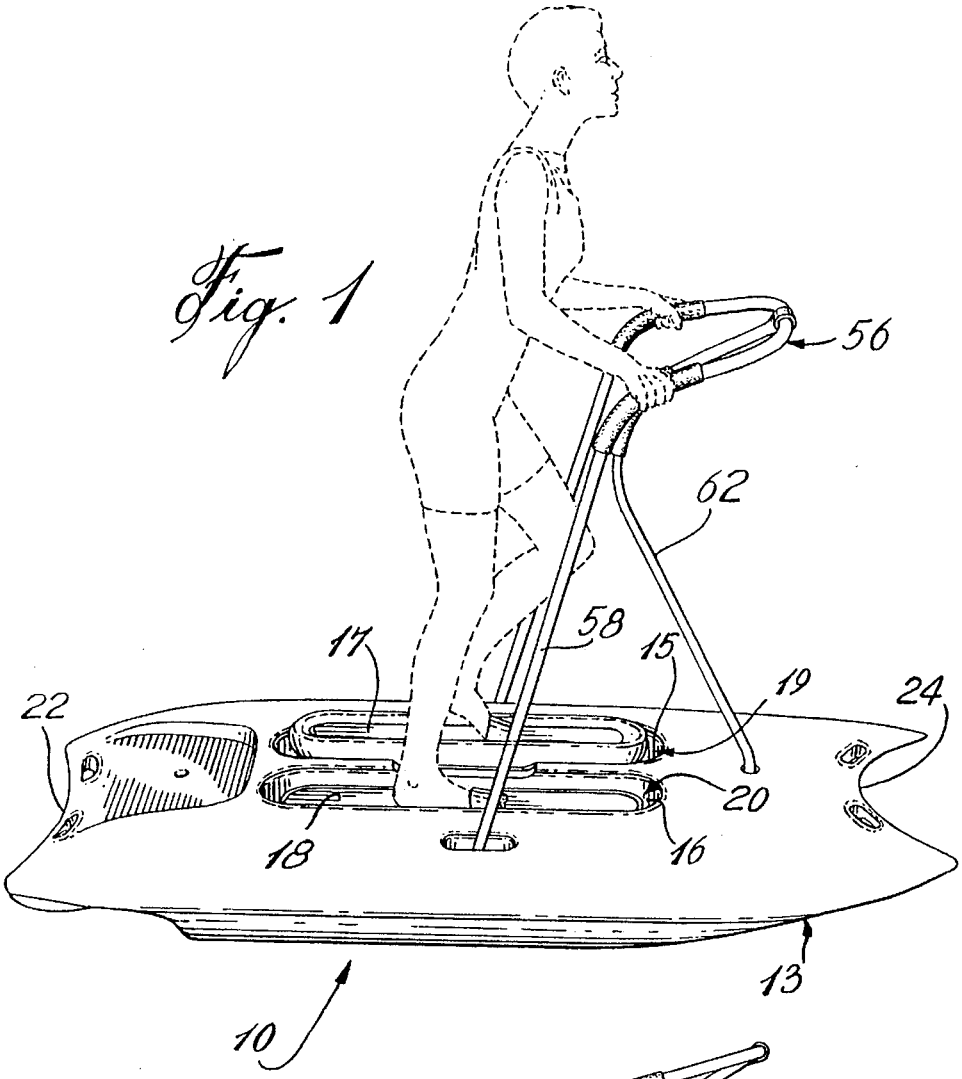
FIG. 1 is a perspective view of a novel water walking apparatus mounting a user thereon.
Figure 4:
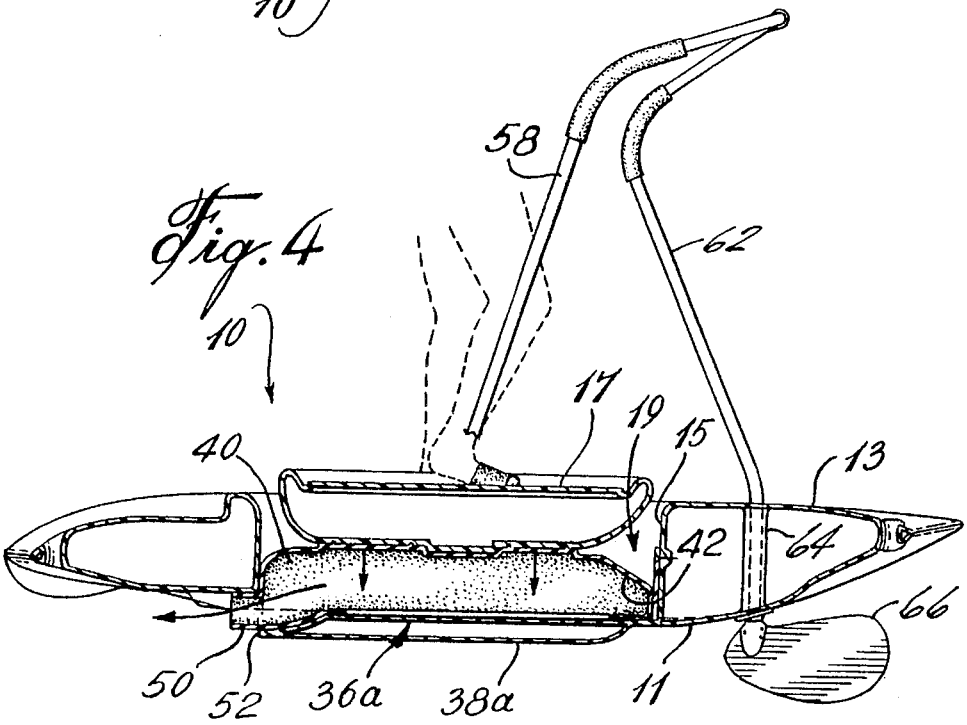
FIG. 4 is a vertical longitudinal cross-section taken along line 4—4 of FIG. 2.

Referring to FIG. 1, the water walking apparatus indicated generally at 10, includes a float member 13. The float member 13 has top openings 15 and 16. Pistons 17 and 18 extend into the openings 15 and 16 respectively and can slide vertically within chambers 19, 20.

Figure 3:
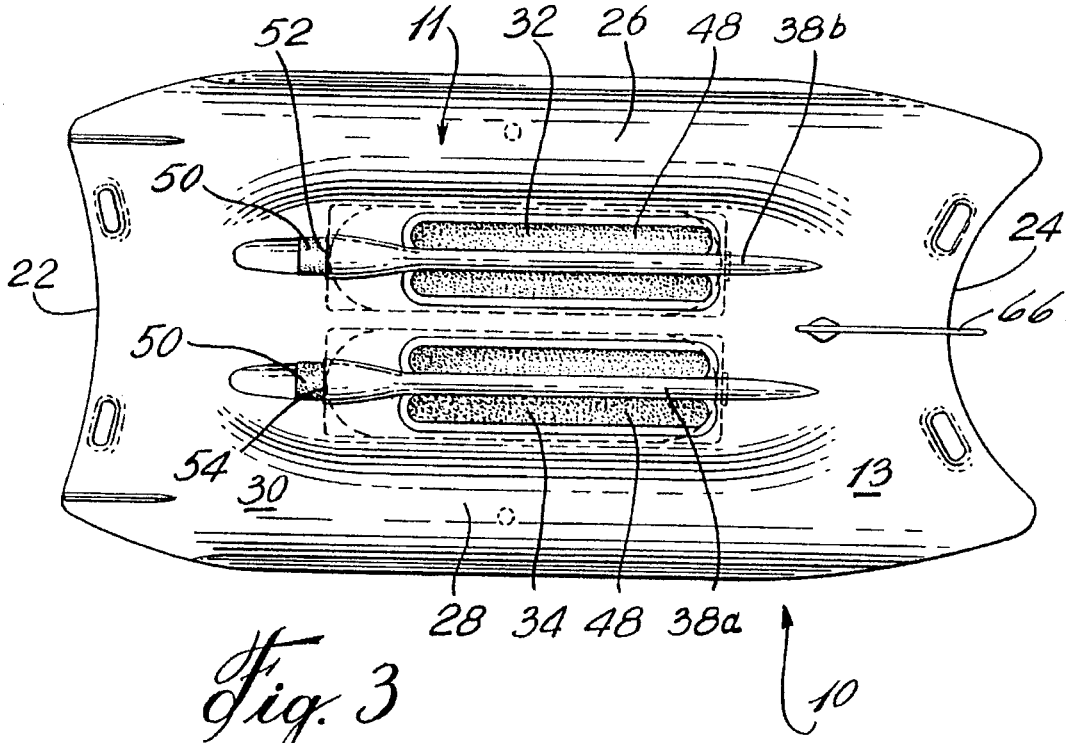
FIG. 3 is a bottom plan view of the embodiment shown in FIG. 1.
Figure 2:
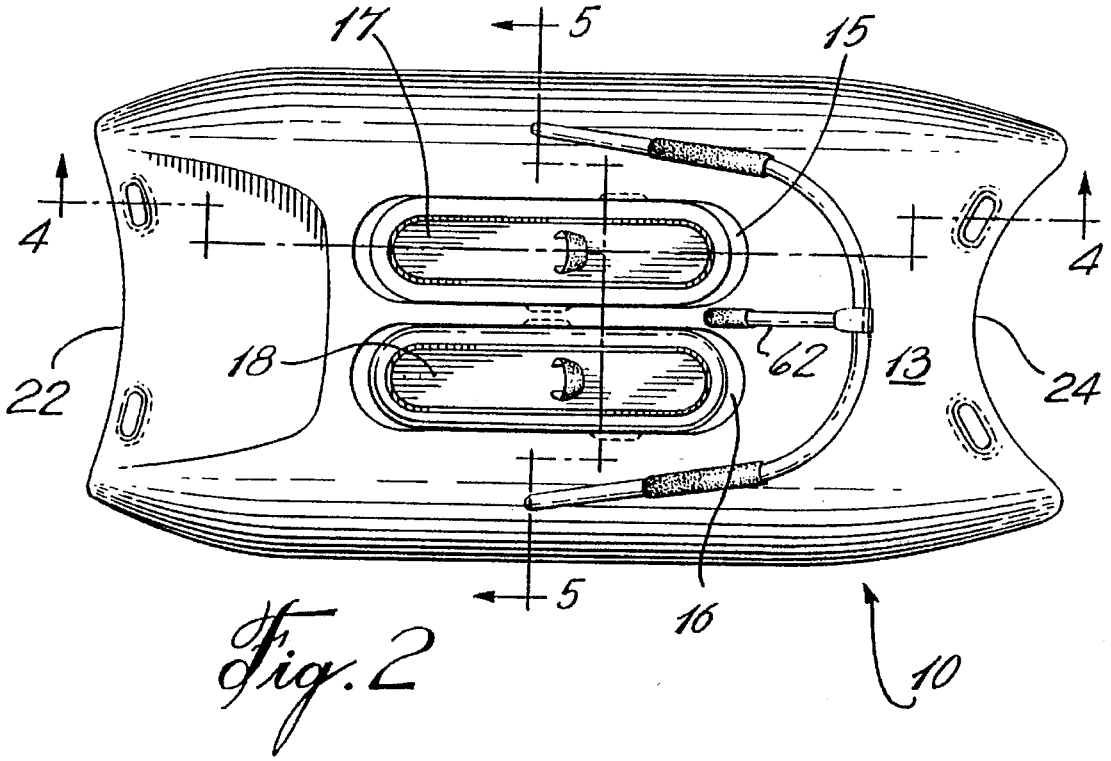
FIG. 2 is a top plan view of the embodiment shown in FIG. 1.

It is noted that the float member 13 comprises a very stable structure which is especially adapted for a water walking apparatus. As can be seen in FIGS. 2 and 3 the bow and stern of the float member 13 includes concave arcs 22 and 24. FIG. 3 shows concave longitudinal channels 26, 28 at either side of the bottom surface 30 of the float member 13 in order to ensure stability.

The float member 13 includes two parallel elongated chambers 19, 20, coincident with top openings 15, 16, which extend longitudinally of the float member 13. The chambers 19, 20 extend downwardly through the float 13, to define openings 32, 34 at the bottom surface 11 coincident with the chambers 19 and 20 respectively. The openings 32, 34 extend longitudinally of the chambers 19, 20 substantially along most of the length of each chamber respectively. The chambers 19, 20 are shown in dotted lines in FIG. 3 relative to the extent of openings 32, 34. The float member 13 when placed on a body of water will displace water to a depth of between 10 cm to 18 cm (4" and 7"). Each chamber has a width of 20 cm to 23 cm (8" to 9") and a length of 76 cm (30"). The distance between the centerlines of each chamber 19 and 20 is 25 cm to 30.5 cm (10" to 12").

Figure 5:
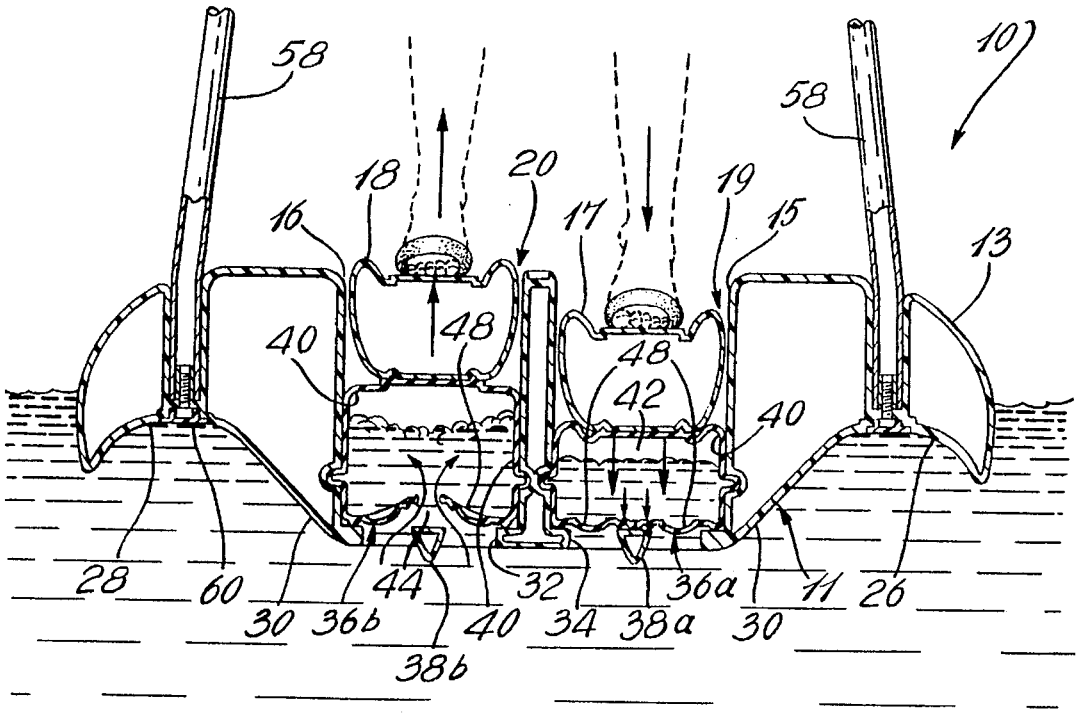
FIG. 5 is a vertical, transverse cross-section taken along line 5—5 of FIG. 2.

Each chamber 19, 20 is elongated in the longitudinal direction of the float 13. An elongated bladder 36*a,b* is located in the bottom portion of each chamber 19, 20 respectively and extends substantially the full length of each chamber 19, 20. The bladders 36*a, b* are also shown in dotted lines in FIG. 3. An elongated beam 38*a,b* bisects longitudinally each opening 32 and 34 respectively and is molded integrally with the float 13. The bladder 36*a* rests on beam 38*a* for instance as shown in FIGS. 3 and 5. Each bladder 36*a,b* can contain 30 to 35 liters of water when filled.

Figure 6:
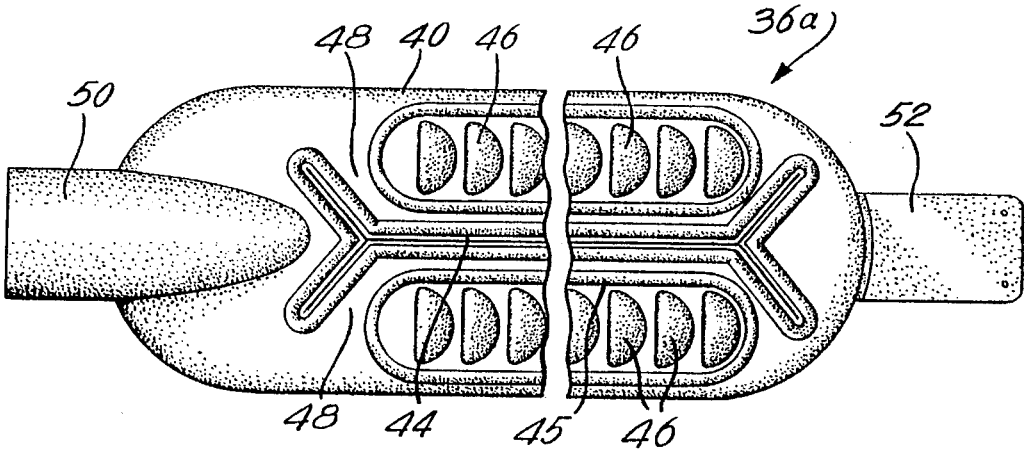
FIG. 6 is a fragmentary bottom plan view of a detail of FIG. 3.

Bladder 36*a* is illustrated in FIGS. 5 and 6 and includes a flexible envelope 40 defining a chamber 42 and having an elongated slit 44 terminating in a Y shape at both ends thereof. The slit 44 is bounded by a lip 45 to prevent tearing. The envelope 40 is made of rubber or other elastomeric material. The bottom wall of the envelope includes transverse ribs 46 on either side of the slit 44 to provide reinforced panels 48 defined by the slit 44 in order to form an elongated flap valve. As shown in FIGS. 3 and 5, the panels 48 including lips 45, normally rest against beam 38*a*. Since the openings 32 and 34 are below the surface of the water, water will flood the chamber 42 causing the panels 48 to rotate inwardly, away from beam 38*b*. The flap valve is closed when the chamber 44 is full of water and thus panels 48 close against beam 38*a*. An exhaust tube 50 extends from one end of the bladder 36*a* and a tab 52 is formed at the other end of the envelope 40 which serves to mount the bladder 36*a* in chamber 19. The exhaust tube 50 will act as a nozzle to form the water jet.

Piston 17 is located in the upper half of the chamber 19 and can extend the full length of the bladder 36*a*. The piston 17 is a rigid body, preferably a hollow molded plastic body, having a foot engaging surface on the top thereof, and the bottom surface engages the top of the bladder 36*a*. The piston 18 is identical to the piston 17.

As shown in FIG. 3, the nozzle or exhaust tube 50 passes through rear opening 52 at the rear of the chamber 19. There is also a similar opening 54 at the rear end of the chamber 20 as well.

The bladders in the chambers and hull or floating member could also be designed so that the openings, i.e. slits, are formed on the sides of the chambers, as long as these openings are submerged when the hull or floating device is on a body of water.

A handle 56 is provided for supporting the user 100. The handle includes a U-shaped handle bar 58 anchored in the float 13 at 60*a* and 60*b*. A steering arm 62 is hinged to the handle bar 58 and is journalled in float 13 at 64. The steering arm 62 is connected to a rudder 66. The handle 56 permits the user to apply as much pressure as need be when pushing on a piston 17 or 18. It is noted that the handle 56 together with the structure of the float member 13 permit vigorous pushing on the pistons 17, 18 by the feet of the user without any fear of capsizing or sideward rocking and rolling.

In operation, in order to draw water into a chamber, the user would shift his weight from piston 17 onto piston 18 allowing water to rush into the chamber 42 of bladder 36*a* through the flap valve formed by panels 48 through the opening 32 in the bottom surface 11. This is possible since the opening 32 is below the surface of the water. It is noted that water entering through the flap valve which extends the full length of slit 44 will very quickly flood the chamber 42. This is contrasted to prior art devices where the water enters through the front end of the chamber and then has to flow along the length of the chamber before it could start rising upwardly.

To eject water through tube 50 at rear opening 52, the user steps downwardly on the piston 17 overlying the bladder 36*a*. The piston 17 forces the water out through the nozzle formed by exhaust tube 50 creating a jet of water. The flap valve is closed simultaneously by this action by closing the panels 48 against beam 38*a*.

When the piston 17 is being pressed down to collapse the bladder 36*a*, the bladder 36*b* is relaxed and water floods into the chamber 42 forcing the piston 18 to move up to the top of the chamber 20.

It will of course be appreciated that in order for the present invention to operate efficiently, it is necessary that the flap valves are large and extend substantially along the full dimension of the portion of the bladders 36*a*, 36*b* that is exposed at openings 32 and 34 respectively.

With the design as presently constituted, a user can walk in a natural gate as the chambers will fill up fast enough so that there is little need to hesitate between steps.

The device can be used as an exerciser similar to a step machine.

Although a particular embodiment has been described, this was for the purpose of illustrating, but not limiting, the invention. Various modifications, which will come readily to the mind of one skilled in the art, are within the scope of the invention as defined in the appended claims.

I claim:

1. Water walking apparatus for moving a user across water, comprising:

a float member having top and bottom surfaces with a front and rear end and defining a longitudinal axis;

a pair of left and right elongated chambers extending between the top and bottom surfaces and defining top and bottom openings respectively, wherein each chamber has a major axis parallel to the longitudinal axis of the float;

each chamber communicating with an exhaust opening at the bottom of the float that is directed towards the rear end;

valve means at the bottom opening of each left and right chamber extending along the major axis of each chamber for permitting water to enter through said bottom openings;

a flexible bladder membrane extending across each chamber to define a sub-chamber with said valve at the bottom opening within each left and right chamber; and a foot engageable piston in each left and right chamber supported on said bladder membrane whereby, when pressure is applied by a person's foot to said piston, water is displaced from the sub-chamber through the exhaust opening to create a jet action for moving said float across the water.

2. Apparatus as defined in claim 1 wherein said foot operated piston for ejecting water include;

a piston extending into each said first and second chamber through said top opening.

3. Apparatus as defined in claim 1 and wherein said valve means are one way valves mounted at the bottom openings of said left and right chambers;

said one way valve means being pivotally mounted to permit the entry of water into said chambers through said bottom openings and the ejection of water from said chambers through said exhaust openings when a respective piston is forced down a respective chamber when filled with water, closing the one way valves;

whereby said apparatus is jet propelled by the action of said user.

4. Apparatus as defined in claim 3 and including an inverted U-shaped upstanding handle fixedly mounted on the top surface of said float member.

5. Apparatus as defined in claim 3 wherein a flexible bladder is located within each said chamber and extends over the bottom opening and said one way valve means is formed in a bottom wall of said bladder coincident with said bottom opening and the exhaust opening includes a short tube extending from one end of the bladder.

6. Apparatus as defined in claim 5 wherein the float includes an elongated beam extending along the longest dimension of each of the bottom openings to bisect the opening and the one way valve means on the bottom wall of the bladder includes a pair of panels formed therein and hinged to move between a valve closed position engaging the beam and closing the opening on both sides of the beam thereby preventing water in the bladder from escaping through the bottom opening and a valve open position spaced from the beam inwardly of the bladder to allow water to flood into the bladder.

7. Apparatus as defined in claim 6 wherein the piston sits on the bladder in the chamber such that when a downward pressure is applied to the piston from the top opening and the float is on water, the piston causes the bladder to collapse and the one way valve to close due to the weight of the water in the bladder on the panels while forcing the water to exit as a jet through the tube at the end of the bladder, and when the pressure on the piston is released water will flood the bladder through the one way valve by moving the panels to a valve open position and thus fill the bladder.

* * * * *